United States Patent [19]

Oikawa et al.

[11] Patent Number: 4,883,027

[45] Date of Patent: Nov. 28, 1989

[54] VALVE OPERATING SYSTEM FOR INTERNAL COMBUSTION ENGINES

[75] Inventors: Toshihiro Oikawa; Tsuneo Tanai; Noriyuki Yamada; Tsutomu Saka; Toshiki Kobayashi, all of Saitama, Japan

[73] Assignee: Honda Giken Kogyo Kabushiki Kaisha, Tokyo, Japan

[21] Appl. No.: 276,403

[22] Filed: Nov. 23, 1988

[30] Foreign Application Priority Data

| | | | |
|---|---|---|---|
| Nov. 25, 1987 | [JP] | Japan | 62-178966 |
| Oct. 11, 1988 | [JP] | Japan | 63-132442 |
| Oct. 11, 1988 | [JP] | Japan | 63-132443 |
| Nov. 7, 1988 | [JP] | Japan | 63-145108 |

[51] Int. Cl.[4] ..... F01L 1/34; F01M 9/10

[52] U.S. Cl. ..... 123/90.16; 123/90.33

[58] Field of Search ..... 123/90.15, 90.16, 90.22, 123/90.23

[56] References Cited

U.S. PATENT DOCUMENTS

| | | | |
|---|---|---|---|
| 4,612,884 | 9/1986 | Ajiki et al. | 123/90.16 |
| 4,727,831 | 5/1988 | Nagahiro et al. | 123/90.16 |
| 4,741,297 | 5/1988 | Nagahiro et al. | 123/90.16 |
| 4,768,467 | 9/1988 | Yamada et al. | 123/90.16 |
| 4,768,475 | 9/1988 | Ikemura | 123/90.16 |
| 4,788,946 | 12/1988 | Inoue et al. | 123/90.16 |

*Primary Examiner*—Charles J. Myhre
*Assistant Examiner*—Weilun Lo
*Attorney, Agent, or Firm*—Lyon & Lyon

[57] ABSTRACT

A drive cam follower operatively connected to an engine valve and a free cam follower capable of becoming free relative to the engine valve are adjacently disposed and adapted to impart in mutually different modes of operation in response to said engine valve rotation of a cam shaft. A connection change-over mechanism is provided between the cam followers and is capable of changing-over the interconnection and disconnection thereof, and resilient biasing means is provided between the free cam follower and the engine body for resiliently urging the free cam follower toward the cam shaft. The resilient biasing means comprises an urging piston slidably received in the engine body for abutment against the free cam follower, and a spring arrangement interposed between the urging piston and the engine body to resiliently bias the urging piston in a direction to abut against the free cam follower. The spring arrangement may comprise series-related springs having different spring constant with one of the springs having a non-linear load characteristic. A vent opening and a lubrication arrangement are provided to facilitate operation of the piston. The urging piston is provided, at its end closer to the free cam follower, with an abutment formed with a smaller diameter to abut against the free cam follower. This facilitates assembly of the resilient biasing means to the engine body, and makes it possible to dispose the resilient biasing means in proximity to a pivoting point of the free cam follower.

16 Claims, 16 Drawing Sheets

VALVE OPERATING SYSTEM FOR INTERNAL COMBUSTION ENGINES

BACKGROUND OF THE INVENTION

1. FIELD OF THE INVENTION

The present invention relates to a valve operating system for internal combustion engines, comprising a drive cam follower operatively connected to an engine valve, a free cam follower capable of operation independent of the drive cam follower relative to the engine valve, the cam followers being adjacently disposed and arranged to operate the valve in mutually different modes in response to rotation of a cam shaft, a connection change-over mechanism is provided between the cam followers and is capable of changing-over the interconnection and disconnection thereof, and resilient biasing means is provided between the free cam follower and the engine body for resiliently urging the free cam follower toward the cam shaft.

2. DESCRIPTION OF THE PRIOR ART

Such valve operating system for internal combustion engines is conventionally know, for example, from Japanese patent application Laid-open No. 19911/86.

However, in order to reduce the power for driving each cam follower in such valve operating system, it is necessary to reduce the inertial weight of each cam follower to the utmost. In order to reduce the inertial weight of the free cam follower, it is desirable to place the sliding point of the urging piston in the resiliently biasing means as close as possible to the pivot point of the free cam follower. In the prior art system, however, the sliding point of the urging piston on the free cam follower cannot be disposed in sufficient proximity to the pivoting point of the free cam follower due to the need for avoidance of any interference of the urging piston with the pivoting point of the free cam follower.

SUMMARY OF THE INVENTION

The present invention has been accomplished with the above circumstances in view, and it is an object of the present invention to provide a valve operating system for internal combustion engine, wherein the resilient biasing means can be disposed in sufficient proximity to the pivot point of the free cam follower.

To attain the above object, according to the present invention, the resiliently biasing means comprises an urging piston slidably received in the engine body for abutment against the free cam follower. A spring is interposed between the urging piston and the engine body to resiliently bias the urging piston in a direction to abut against the free cam follower, the urging piston being provided, at its end closer to the free cam follower, with an abutment formed at a smaller diameter to abut against the free cam follower.

With the above construction, since the urging piston is provided at its end closer to the free cam follower with the abutment formed at a smaller diameter to abut against the free cam follower, the resilient biasing means can be disposed in closer proximity to the pivot point of the free cam follower, thereby reducing the inertial weight of the cam follower.

According to another aspect of the present invention, a bottomed cylindrical guide member in which the urging piston is slidably received is fitted in the engine body, and a stopper is detachably secured to the inner surface of the guide member adjacent its opened end. Thus, the resilient biasing means can be assembled in a unit construction by successively inserting the spring and the urging piston into the guide member and securing the stopper to the guide member, and the resilient biasing means as a unit then assembled to the engine body. Accordingly, the assembling operation is extremely facilitated.

According to a further aspect of the present invention, the spring arrangement comprises first and second springs, a retainer is interposed between the first and second springs and provides projections for fitting of ends thereof. The projections are provided respectively on two opposed surfaces of the retainer that is body formed as a disk to receive the first and second springs. This increases the strength of the retainer while avoiding an increase in its diameter.

According to another aspect of the present invention, at least the second spring of the first and second springs comprises a coiled spring having a non-linear load characteristic whereby its load is increased in variation with an increase in the amount of displacement, but having a substantially uniform diameter. This makes it possible to prevent the occurrence of any surging phenomenon during a high speed operation of the engine to avoid the generation of any impact noise, while avoiding an increase in loss of friction during a low speed operation, without any attendant increase in size of the resilient biasing means.

According to a yet further aspect of the present invention, the bottomed cylindrical guide member in which the urging piston is slidably received is fitted in the engine body, and the urging piston has an ejecting aperture provided therein and opened at its end closer to the free cam follower. The cylinder head of the engine body includes a lubricating oil inlet passage provided therein and opened to an upper surface thereof to introduce lubricating oil. The guide member is provided with a lubricating oil inlet hole communicating with the lubricating oil inlet passage and capable of being closed by the urging piston. Thus, the lubricating oil introduced between the urging piston and the guide member via the lubricating oil inlet passage and the lubricating oil inlet hole can be ejected through the ejecting aperture by operation of the urging piston in response to the operation of the free cam follower. The ejection of the lubricating oil is available toward portions other than the resilient biasing means in the valve operating system, and this contributes to a reduction in the amount of lubricating oil to be supplied to the entire valve operating system.

The above and other objects, features and advantages of the invention will become apparent from a reading of the following description of the preferred embodiments thereof, taken in conjunction with the accompanying drawings.

BRIEF DESCRIPTION OF THE DRAWINGS

FIGS. 1 to 14 illustrate a first embodiment of the present invention, wherein FIG. 1 is a longitudinal sectional view of an essential portion of an internal combustion engine, taken along a line I—I in FIG. 2;

FIG. 2 is a view taken along a line II—II in FIG. 1;

FIG. 3 is a sectional view taken along a line III—III in FIG. 2;

FIG. 4 is a sectional view taken along a line IV—IV in FIG. 1;

FIG. 5 is a sectional view taken along a line V—V in FIG. 2;

FIG. 6 is an enlarged longitudinal sectional view of resilient biasing means;

FIG. 7 is a view taken along a line VII—VII in FIG. 6;

FIG. 8 is a sectional view taken along a line VIII—VIII in FIG. 6;

FIG. 9 is an enlarged sectional view taken along a line IX—IX in FIG. 1;

FIG. 10 is a diagram illustrating an oil supply system;

FIG. 11 is a view taken along a line XI—XI in FIG. 2;

FIG. 12 is a sectional view taken along a line XII—XII in FIG. 11;

FIG. 13 is an enlarged sectional view taken along a line XIII—XIII in FIG. 11 with the directional control valve in the closed position; and FIG. 14 is a sectional view taken along line XIV—XIV in FIG. 2.

DESCRIPTION OF THE PREFERRED EMBODIMENTS

The present invention will now be described by way of embodiments with reference to the accompanying drawings.

Figure 1:
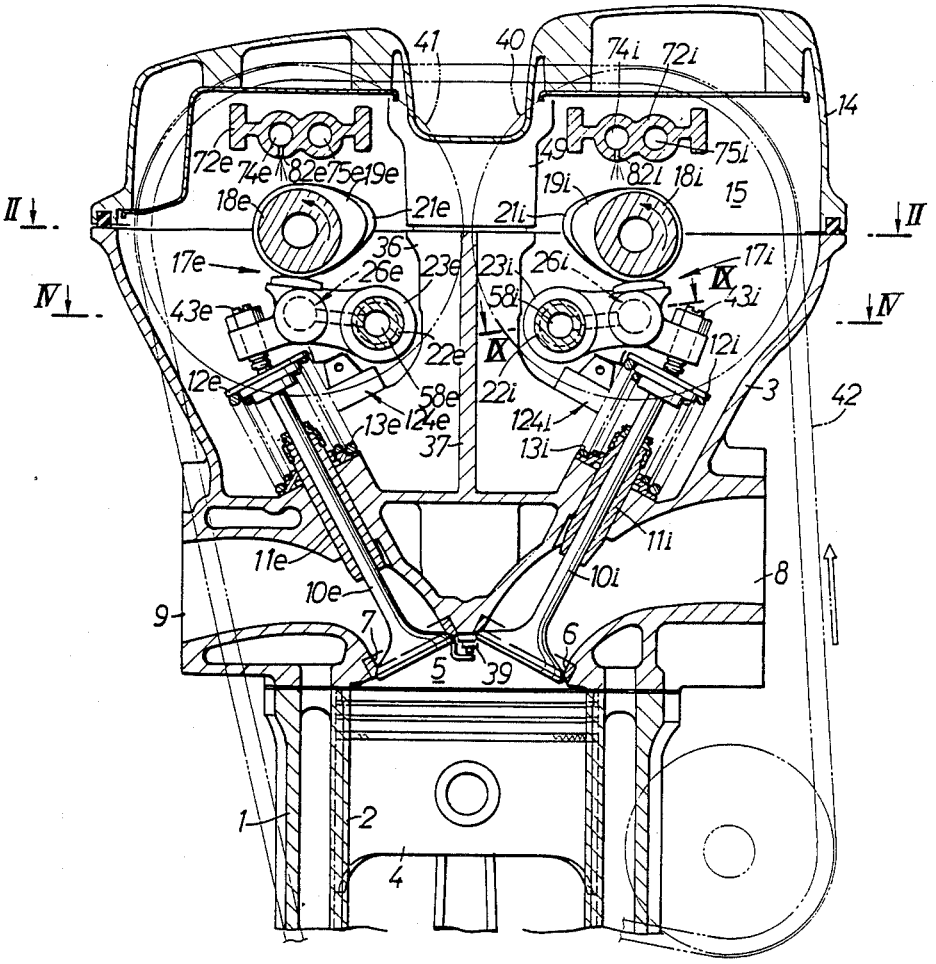
Figure 2:
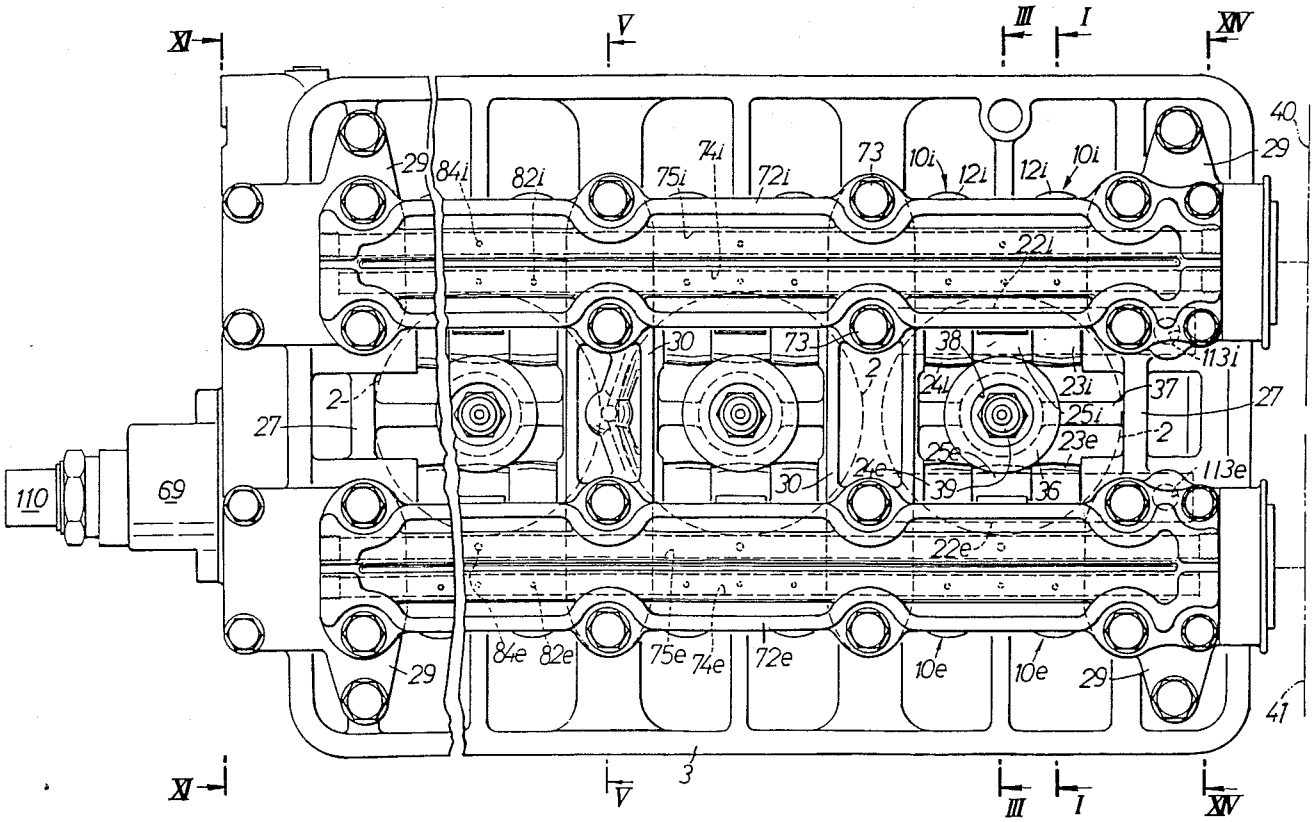

A first embodiment of the present invention will be first described with reference to FIGS. 1 to 4. Referring to FIGS. 1 and 2, a DOHC type multi-cylinder internal combustion engine carried on a vehicle comprises four cylinders 2 arranged in series within a cylinder block 1. A combustion chamber 5 is defined between a cylinder head 3 connected to an upper end of the cylinder block 1 and a piston 4 slidably received of each of the cylinders 2. A pair of intake ports 6 and a pair of exhaust ports 7 are provided in the cylinder head 3 at its portion forming a ceiling surface of each of the combustion chambers 5. Each of the intake ports 6 is connected to an intake passage 8 opened in one side of the cylinder head 3, and each of the exhaust ports 7 is connected to an exhaust passage 9 opened in the other side of the cylinder head 3.

Guide tubes 124*i* and 124*e* are fixedly fitted in a portion of the cylinder head 3 corresponding to each cylinder 2 to guide intake valves 10*i* as a pair of engine valves capable of opening and closing the corresponding intake ports 6 and exhaust valves 10*e* as a pair of engine valves capable of opening and closing the corresponding exhaust ports 7, and valve springs 13*i* and 13*e* are mounted in compression between the cylinder head 3 and collers 12*i* and 12*e*, respectively provided on upper ends of each intake valve 10*i* and each exhaust valve 10*e* projecting upwardly from the guide tubes 124*i* and 124*e* so that the individual intake and exhaust valves 10*i* and 10*e* are biased upwardly, i.e., in a closing direction by these valve springs 13*i* and 13*e*.

An operation chamber 15 is defined between the cylinder head 3 and a head cover 14 coupled to an upper end of the cylinder head 3. Contained and disposed in the operation chamber 15 are an intake valve operating device 17*i* for driving the intake valves 10*i* of each cylinder 2 for opening and closing, and an exhaust valve operating device 17*e* for driving the exhaust valves 10*e* of each cylinder 2 for opening and closing. The valve operating devices 17*i* and 17*e* have basically the same construction. Therefore, the intake valve operating device 17*i* will be described and shown with its portions indicated by reference characters with suffixes i, and the exhaust valve operating device 17*e* is only shown with its portions indicated by reference characters with suffixes e.

Figure 3:
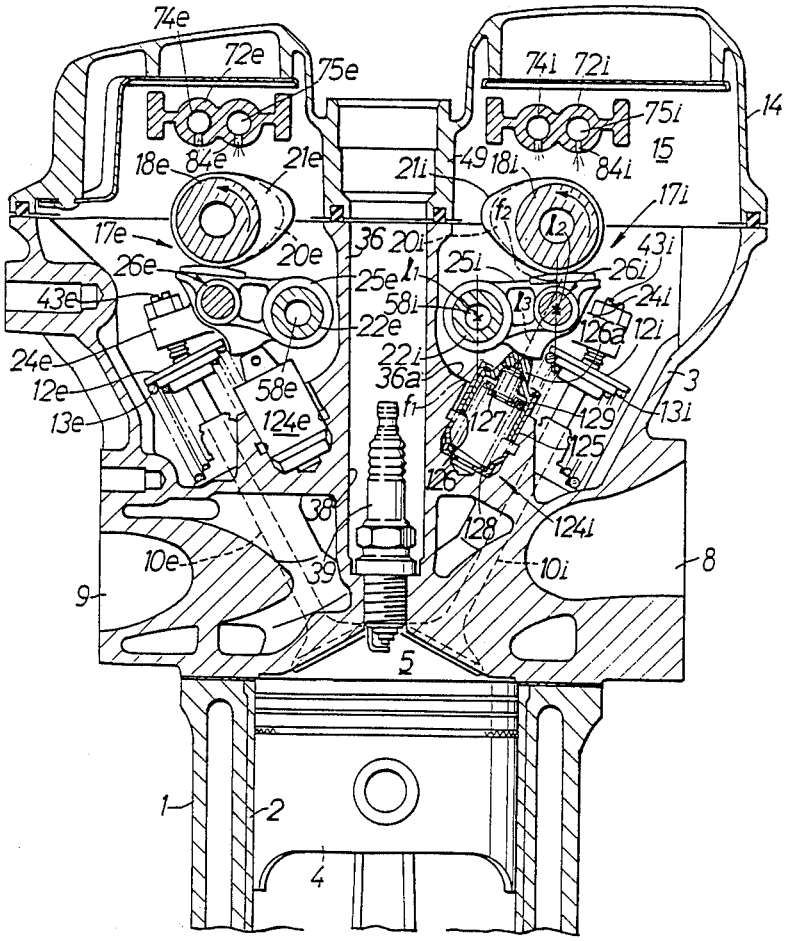
Figure 4:
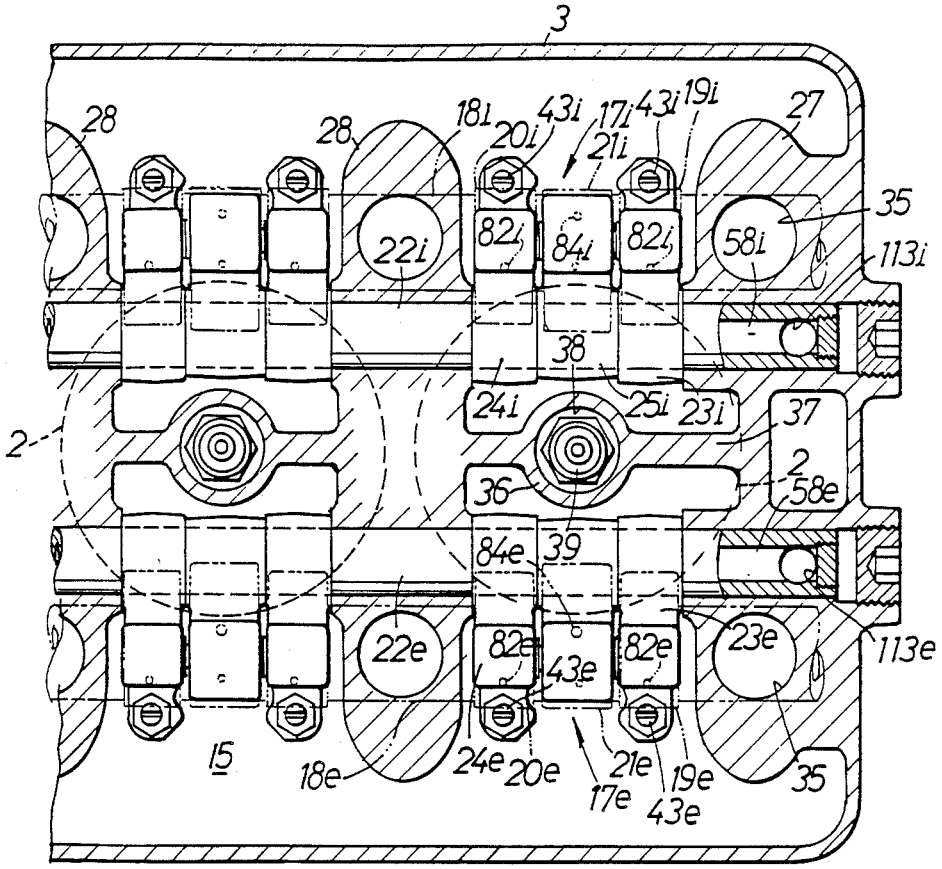

Referring also to FIGS. 3 and 4, the intake valve operating device 17*i* comprises a cam shaft 18*i* driven for rotation at a reduction ratio of 1/2 from an engine crank shaft which is not shown, low speed cams 19*i* and 20*i* and a high speed cam 21*i* mounted on the cam shaft 18*i* in correspondence to each cylinder 2, a rocker shaft 22*i* fixedly disposed in parallel to the cam shaft 18*i*, a first drive rocker arm 23*i*, a second drive rocker arm 23*i*, and a free rocker arm 25*i* which are all pivotally mounted on the rocker shaft 22*i* in correspondence to each cylinder 2, and hydraulic connection change-over mechanisms 26*i* respectively provided between the individual rocker arms 23*i*, 24*i* and 25*i* in correspondence to each cylinder 2.

Figure 5:
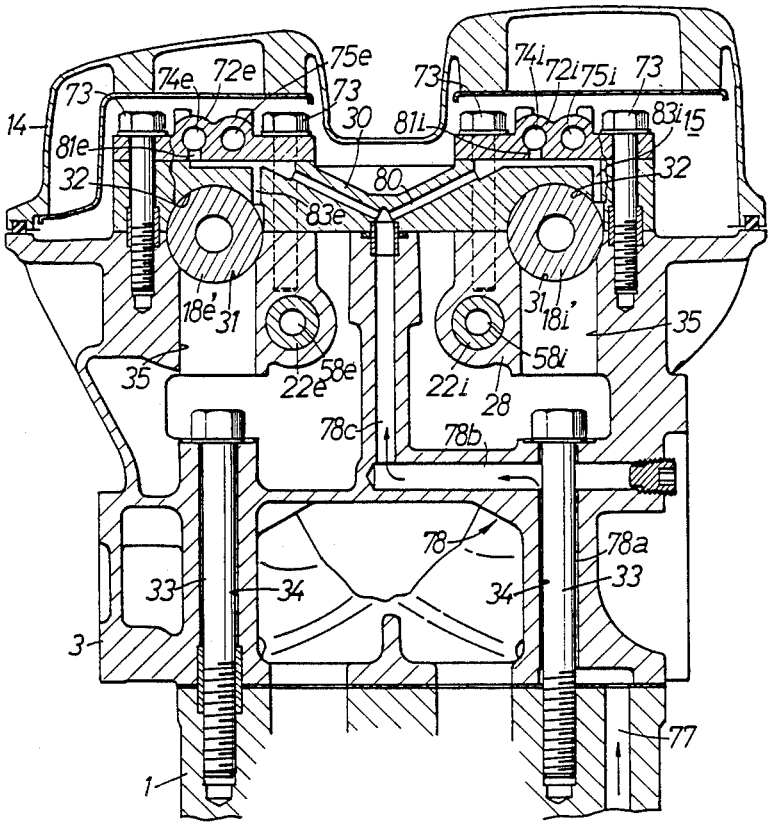

Referring also to FIG. 5, the cam shaft 18*i* is axially rotatably disposed in parallel to a direction of arrangement of the cylinders 2 above the cylinder head 3. The cylinder head 3 includes cam supports 27 and 27 integrally provided at its opposite ends in the direction of arrangement of the cylinders 2, and three cam supports 28 integrally provided at locations corresponding to portions between the cylinders 2. The cam shaft 18*i* is axially rotatably supported by cam holders 29 and 29 respectively fastened on the cam supports at the opposite ends, by cam holders 30 respectively fastened on the three cam supports 28 and by the cam supports 27 and 28. Moreover, the cam holders 29 are mounted independently on the intake valve operating device 17*i* and the exhaust valve operating device 17*e*, respectively, whereas the cam holders 30 are commonly disposed on the both valve operating devices 17*i* and 17*e*. Semi-circular support surfaces 31 are provided on upper surfaces of the cam supports 27 and 28 for supporting lower half outer peripheral surfaces of the cam shafts 18*i* and 18*e*, respectively, while semi-circular support surfaces 32 are provided on lower surfaces of the cam holders 29 and 30 for supporting upper half outer peripheral surfaces of the cam shafts 18*i* and 18*e*, respectively.

Each of the cam supports 27 and 28 is provided with a pair of vertically extending insert holes 34, at locations corresponding to the cam shafts 18*i* and 18*e*, for permitting of insertion of bolts 33 for fastening the cylinder head 3 to the cylinder block 1, and with vertically extending operation holes 35 opened at their upper ends in the semi-circular support surfaces 31, at upper locations correspondence to these insert holes 34, for permitting rotational operation of the bolts 33.

The cylinder block 3 is integrally provided with vertically extending cylindrical central blocks 36 at places corresponding to a central portion of each cylinder 2 between the cam supports 27 and 28. Each of the central blocks 36 is interconnected with adjacent ones of the cam supports 27 and 28 on the opposite sides thereof by a support wall 37. The head cover 14 is also provided with a cylindrical central block 49 connected to the central block 36. Each of the central blocks 36 and 49 is provided with a plug inset hole 38 through which is placed a spark plug 39 projecting into the combustion chamber 5.

Timing pulleys are fixedly mounted at one end of both the cam shafts 18*i* and 18*e* projecting from the cylinder head 3 and the head cover 14, respectively, and a timing belt 42 is passed around the timing pulleys 40 and 41 for transmitting the driving force from the crank shaft which is not shown. This permits the cam shafts **18*i* and 18*e*** to be rotated in the same direction.

The cam shaft **18*i* is integrally provided with low speed cams 19*i* and 20*i* at locations corresponding to the individual intake valves 10*i* and with high speed cam 21*i* between the low speed cams 19*i* and 20*i*. On the other hand, the rocker arm 22*i* is fixedly supported below the cam shaft 18*i* by the cam supports 27 and 28 to have an axis parallel to the cam shaft 18*i*. Pivotally supported on the rocker shaft 22*i* in mutually adjacent relation are a first drive rocker arm 23*i* operatively connected to one of the intake valves 10*i*, a second rocker arm 24*i* operatively connected to the other intake valve 10*i*, and a free rocker arm 25*i* disposed between the first and second drive rocker arms 23*i* and 24*i***.

Tappet screws **43*i* are threadedly inserted in the first and second drive rocker arms 23*i* and 24*i* for advancing and retreating movements, respectively to abut against the upper ends of the corresponding intake valves 10*i*, whereby the drive rocker arms 23*i* and 24*i* are operatively connected to the intake valves 10*i***, respectively.

Figure 6:
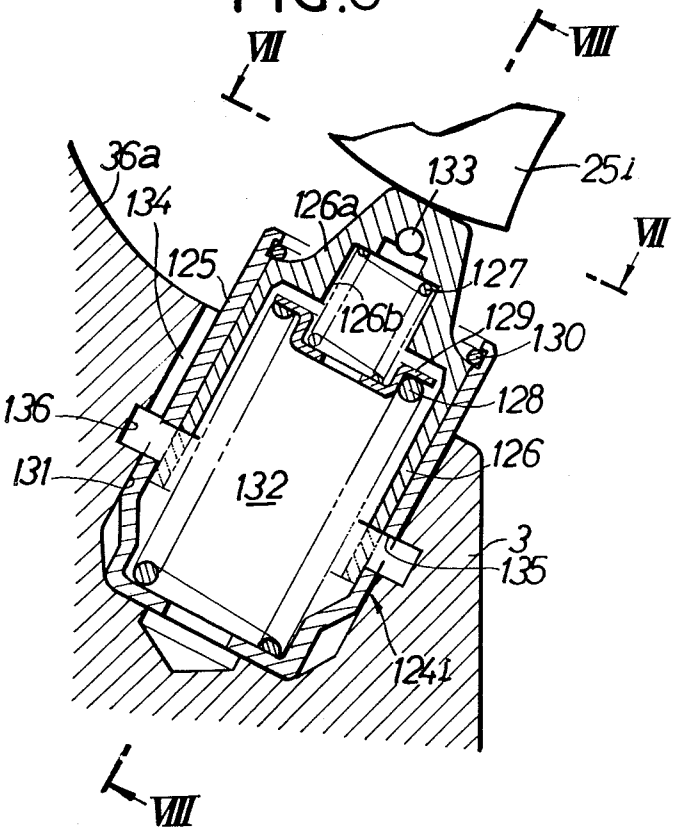
Figure 7:
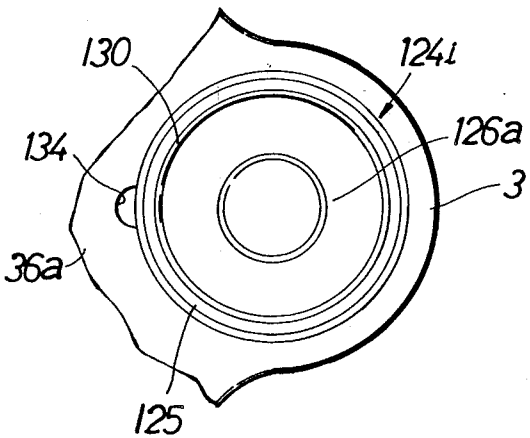
Figure 8:
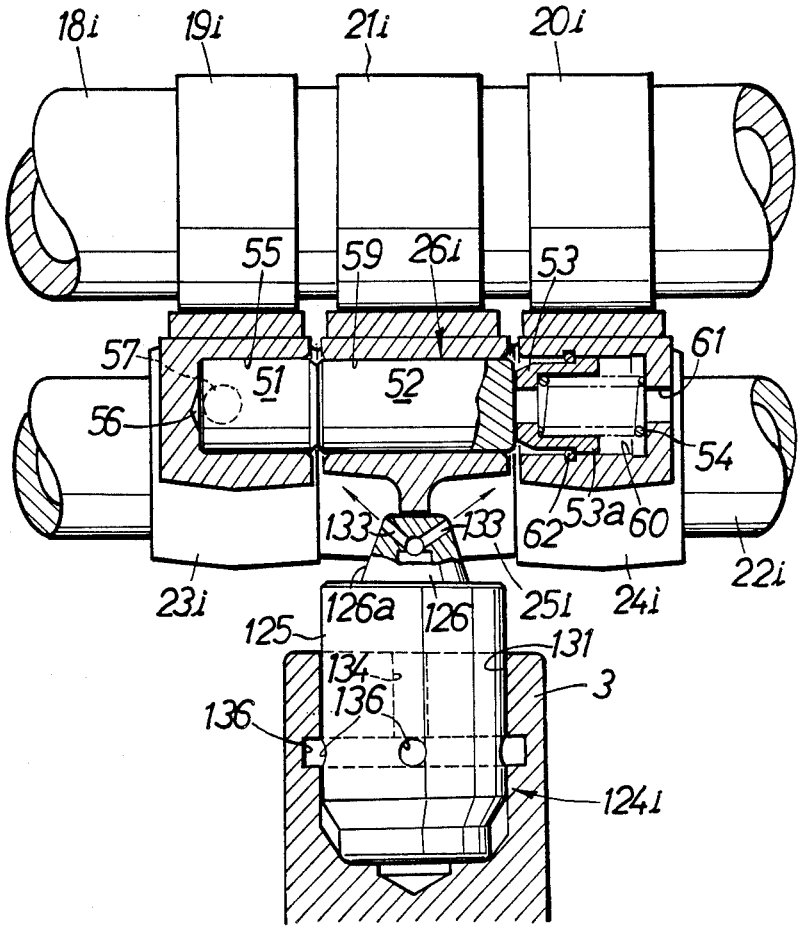

Referring also to FIGS. 6, 7 and 8, the free rocker arm **25*i* is resiliently biased in a direction of slidable contact with the high speed cam 21*i* by resilient biasing means 124*i* interposed between the cylinder head 3 of the engine body. The resilient biasing means 124*i* comprises a bottomed cylindrical guide member 125 fitted in the cylinder head 3 with its closed end close to the cylinder head 3, a basically bottomed cylindrical urging piston 126 slidably received in the guide member 125 and abuttable against a lower surface of the free rocker arm 25*i*, first and second springs 127 and 128 interposed in series between the urging piston 126 and the guide member 125 to bias the urging piston 126 toward the free rocker arm 25*i*, a retainer 129 disposed within the guide member 125 to receive the first and second springs 127 and 128 on its opposite surfaces, and a stopper 130 detachably secured to an inner surface of the guide member 125 near to its opened end to engage the urging piston 126. Moreover, a tapered abutment 126*a* is formed on the end of the urging piston 126 closest to the free rocker arm 25*i* to abut against a lower surface of the free rocker arm 25*i*. The spring constant of the first spring 127 is set at a relatively small level, while that of the second spring 128** is at a relatively large level.

The cylinder head 3 is provided with a bottomed mounting hole 131 in which the guide member 125 is fitted. An oil chamber 132 is defined between the urging piston 126 and the guide member 125. The first spring 127 is mounted in compression between the retainer 129 and the urging piston 126 which are contained in the oil chamber 132, and the second spring 128 is mounted in compression between the retainer 129 and the closed end of the guide member 125. Furthermore, a bottomed small hole **126*b* is coaxially formed in the inner surface at the closed end of the urging piston 126, and the first spring 127 is contained in the small hole 126*b*, thereby prevented from falling. The abutment 126*a* of the urging piston 126 is also provided with a pair of ejection apertures 133 leading to the oil chamber 132. The ejecting direction of the ejection apertures 133 is established to permit the ejection toward the spaces between the free rocker arm 25*i* and the drive rocker arms 23*i* and 24*i* on the opposite sides thereof in a location of disposition of the connection change-over mechanism 26*i*** which will be described hereafter.

In addition, the cylinder head 3 is provided with a lubricating oil inlet passage 134 opened in the upper surface of the cylinder head 3 to introduce lubricating oil, while the guide member 125 is provided with a lubricating oil inley hole 135 communicating with the lubricating oil passage 134 and capable being closed by the urging piston 126. More specifically, an annular groove 136 is provided in the inner surface at an intermediate portion of the mounting hole 131, and the lubricating oil inlet passage 134 is defined by provision of a groove vertically extending along the inner surface of the mounting hole 131. The lubricating oil inlet passage 134 communicates at its lower end with the annular groove 136 and is opened at its upper end in the upper edge of the mounting hole 131. It should be noted that the resilient biasing means **124*i* is disposed to have an axis inclined outwardly and sideways toward the above in the vicinity of the base of the central block 36 in the cylinder head 3, and the lubricating oil inlet passage 134 is disposed on the side of the mounting hole 131 closer to the central block 36. Moreover, the base 36*a* of the central block 36 is formed to be inclined downwardly toward the lubricating oil inlet passage 134**.

The lubricating oil inlet hole 135 is made in the guide member 125 between the position assumed by the lower end edge of the piston 126 when it is in its uppermost limit position (a position shown by a solid line in FIG. 6) and the position assumed by the lower end edge of the urging piston 126 when it is in its lower most limit position (a position shown by a broken line in FIG. 6). Moreover, the annular groove 136 is disposed at a location to normally communicate with the lubricating oil inlet passage 135. Thus, when the urging piston 126 is in the uppermost limit position, the lubricating oil inlet passage 134 is permitted to communicate with the oil chamber 132, and when the urging piston 126 is in the course of downward movement, the lubricating oil inlet hole 135 is closed by the urging piston 126.

The above-described stopper 130 is a retaining ring of a circular shape with a cut portion and is fitted on an inner surface of the guide member 125 closer to its opened end. Furthermore, the stopper 130 is capable of engaging the base end of the abutment **126*a* of the urging piston 126, thereby inhibiting the slipping-off of the urging piton 126 from the guide member 125**.

The resilient biasing means **124*i* is disposed in proximity to the pivot point of the free rocker arm 25*i*, i.e., to the center line $l_1$ of the rocker shaft 22*i*. Specifically, the resilient biasing means 124*i* is disposed either so that an axis $l_3$ extending through the center of the abutment 126*a* of the urging piston 126 passes between the center line $l_1$ of the rocker shaft 22*i* and the center line $l_2$ of the connection change-over mechanism 26*i*, which will be described hereinafter, or so that the abutment 126*a* abuts against the free rocker arm 25*i* between a surface $f_1$ extending through the center line $l_1$ of the rocker shaft 22*i* and parallel to the axis of the cylinder 2 and a surface f2 extending through the center line l2 of the connection change-over mechanism 26*i* and parallel to the axis of the cylinder 2, as shown in FIG. 3**.

Figure 9:
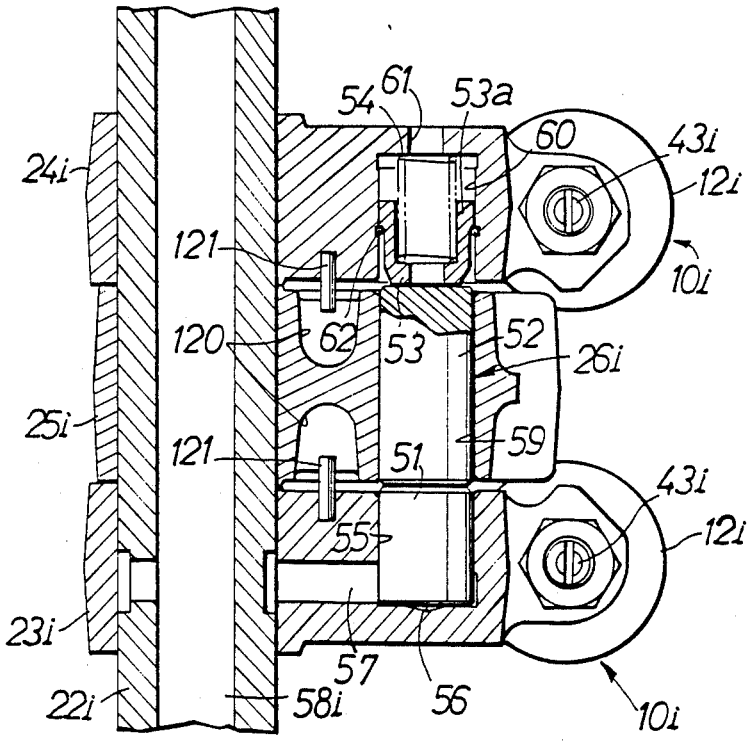

Referring also to FIG. 9, the connection change-over mechanism **26*i* comprises a first change-over pin 51 capable of connecting the first drive rocker arm 23*i* and the free rocker arm 25*i*, a second change-over pin 52 capable of connecting the free rocker arm 25*i* and the second drive rocker arm 24*i*, a restricting pin 53 for restricting the movements of the first and second change-over pins 51 and 52, and a return spring 54 for biasing the individual pins 51 to 53** in the disconnecting direction.

The first drive rocker arm **23*i* is provided with a first bottomed guide hole 55 opened to the free rocker arm 25*i* in parallel to the rocker shaft 22*i*. The first change-over pin 51 is cylindrically formed and is slidably fitted in the first guide hole 55, and a hydraulic pressure chamber 56 is defined between one end of the first change-over pin 51 and the closed end of the first guide hole 55. Further, the first drive rocker arm 23*i* is provided with a passage 57 communicating with the hydraulic pressure chamber 56, and the rocker shaft 22*i* is provided with an oil feed passage 58*i* which normally communicates with the hydraulic pressure chamber 56 through the passage 57 despite oscillation of the first drive rocker arm 23*i***.

The free rocker arm **25*i* is provided with a guide aperture 59 corresponding to the first guide hole 55 and extending in parallel to the rocker shaft 22*i* between opposite side surfaces, and the second change-over pin 52 abutting at an one end thereof against the other end of the first change-over pin 51 is slidably fitted into the guide aperture 59. The second change-over pin 52** is also cylindrically formed.

The second drive rocker arm **24*i* is provided with a second bottomed guide hole 60 corresponding to the guide aperture 59 and opened to the free rocker arm 25*i* in parallel to rocker shaft 22*i*, and the bottomed cylindrical restricting pin 53 abutting against the other end of the second change-over pin 52 is slidably fitted into the second guide hole 60. The restricting pin 53 is disposed with its opened end turned toward the closed end of the second guide hole 60, and has a collar 53*a* projecting radially outwardly at that opened end and that is slidable in the second guide hole 60. The return spring 54 is compressed between the closed end of the second guide hole 60 and the closed end of the restricting pin 53, so that the individual pins 51, 52 and 53 abutting against one another are biased toward the hydraulic chamber 56 by the spring force of the return spring 54*e*. Furthermore, the closed end of the second guide hole 60 is provided with a releasing hole 61** for removal of air and oil.

A retaining ring 62 is fitted on the inner surface of the second guide hole 60 and is capable of engaging the collar **53*a* of the restricting pin 53 to prevent slipping-off of the restricting pin 53 from the second guide hole 60. Moreover, the fitted position of the retaining ring 62 is established so as to prevent the restricting pin 53 from moving further from the abutment against the second change-over pin 52 in a location corresponding to that existing between the free rocker arm 25*i* and the second drive rocker arm 24*i* toward the free rocker arm 25*i***.

With such connection change-over mechanism **26*i*, increasing of the hydraulic pressure in the hydraulic pressure chamber 56 causes the first change-over pin 51 to be fitted into the guide aperture 59, while causing the second change-over pin 52 to be fitted into the second guide hole 60, whereby the individual rocker arms 23*i*, 25*i* and 24*i* are connected. If the hydraulic pressure in the hydraulic pressure chamber 56 is reduced, the first change-over pin 51 is returned by the spring force of the return spring 54 to a position in which the abutment against the second change-over pin 52 corresponds to between the first drive rocker arm 23*i* and the free rocker arm 25*i*, while the second change-over pin 52 is likewise returned to a position in which the abutment against the restricting pin 53 corresponds to that existing between the free rocker arm 25*i* and the second drive rocker arm 24*i* and thus, the connection of the individual rocker arms 23*i*, 25*i* and 24*i*** is released.

Recesses 120 and 120 are provided on the free rocker arm **25*i* at its sides corresponding to the first and second drive rocker arm 23*i* and 24*i* by reducing the wall thickness for lightening purposes, and spring pins 121 are press-fitted into and secured to side surfaces of the first and second drive rocker arms 23*i* and 24*i* corresponding to the recesses 120 to enter the recesses 120. The amount of relative swinging movement of the first and second drive rocker arm 23*i* and 24*i* is thereby restricted by these recesses 120 and 120 and the spring pins 121 and 121, but the first and second drive rocker arm 23*i* and 24*i* is slidable contact with the low speed cams 19*i* and 20*i* and the free rocker arm 25*i* in slidable contact with the high speed cam 21*i* relatively swing when the engine is in low speed operation and therefore, the recesses 120 and 120 are formed so as not to obstruct such relatively swinging movement. Further, the recesses 120 and the spring pins 121 serve to inhibit the individual rocker arm 23*i*, 24*i* and 25*i* from relatively swinging without any restriction during maintenance and to prevent falling-off of the first and second change-over pins 51 and 52**, and so on.

A system for supplying oil to the valve operating devices **17*i* and 17*e* will be described below with reference to FIG. 10. An oil gallery 68 is connected through a relief valve 65, an oil filter 66 and an oil cooler 67 to a discharge port of an oil pump 64 for pumping an oil from oil pan 63, so that an oil pressure is supplied from the oil gallery 68 to the individual connection change-over mechanisms 26*i* and 26*e*, while lubricating oil is supplied from the oil gallery 68 to individual portions to be lubricated of the valve operating devices 17*i* and 17*e***.

A directional control valve 69 is connected to the oil gallery 68 for permitting the high-to-low or low-to-high change-over and supplying of the oil pressure which has passed a filter 70 provided on the way of the oil gallery 68, and the oil feed passages **58*i* and 58*e* within the rocker shafts 22*i* and 22*e* are connected to the oil gallery 68 through this directional control valve 69. Passage defining members 72*i* and 72*e* are fastened to the upper surfaces of the cam holders 29 and 30 by a plurality of bolts 73 that extend in parallel to, and in correspondence with the cam shafts 18*i* and 18*e*. The passage defining member 72*i*, 72*e* is provided with a low speed lubricating oil passage 74*i*, 74*e* closed at its opposite ends, and a high speed lubricating oil passage 75*i*, 75*e* communicating with the oil feed passage 58*i*, 58*e***, these lubricating oil passages being in parallel.

An oil passage 77, which is diverged from the oil gallery 68 upstream of the filter 70 and includes a restriction 79 on the way thereof, is provided to extend upwardly within the cylinder block 1, as shown in FIG. 5. The oil passage 77 is provided in the cylinder block 1 at a substantially central portion in the direction of arrangement of the cylinders 2. On the other hand, a low speed oil pressure feed passage 78 communicating with the oil passage 77 is provided in the cam support 28 at the substantially central portion in the direction of arrangement of the cylinders 2, and is comprised of an annular passage portion **78*a* surrounding the bolt 33, a passage portion 78*b* extending at the central portion between the both valve operating devices 17*i* and 17*e*** in communication with the upper end of the passage portion 78*a*, and a passage portion 78*c* extending upwardly in communication with the passage portion 78*b* and opened in the upper surface of the cam support 28.

The cam holder 30 at the substantially central portion in the direction of arrangement of the cylinders 2 is provided with a generally Y-shaped bifurcated oil passage 80 which has a lower end communicating with the upper end of the passage portion 78*c* of the low speed oil pressure feed passage 78 and is directed to the valve operating devices 17*i* and 17*e*. Upper ends of the bifurcated oil passage 80 are connected to the low speed lubricating oil passages 74*i* and 74*e*, respectively. To this end, the passage defining members 72*i* and 72*e* are provided with communication holes 81*i* and 81*e* for permitting the bifurcated oil passage 80 to communicate with the low speed lubricating oil passages 74*i* and 74*e*, respectively.

The low speed lubricating oil passages 74*i* and 74*e* serve to supply lubricating oil to slide portions between the cams 19*i*, 19*e*, 20*i*, 20*e* and 21*i*, 21*e* and the rocker arms 23*i*, 23*e*, 24*i*, 24*e* and 25*i*, 25*e*, as well as cam journals 18*i*' and 18*e*' of the can shafts 18*i* and 18*e*. For this purpose, the passage defining members 72*i* and 72*e* are provided at their lower surface with lubricating oil ejecting apertures 82*i* and 82*e* communicating with the low speed lubricating oil passage 74*i* and 74*e* in locations corresponding to the low speed cams 19*i*, 19*e*, 20*i* and 20*e* and the high speed cams 21*i* and 21*e*, respectively, and with lubricating oil feed passages 83*i* and 83*e* communicating with the low speed lubricating passage 74*i* and 74*e* to supply lubricating oil to the individual cam journals 18*i*' and 18*e*' of the cam shafts 18*i* and 18*e*, respectively.

The high speed lubricating oil passages 75*i* and 75*e* also serve to supply lubricating oil to slide portions between the high speed cams 21*i* and 21*e* and the free rocker arms 25*i* and 25*e*, and for this purpose, the passage defining members 72*i* and 72*e* are further provided at their lower surfaces with lubricating oil ejecting apertures 84*i* and 84*e* communicating with the high speed lubricating passages 75*i* and 75*e* in locations corresponding to the high speed cams 21*i* and 21*i*, respectively.

Figure 10:
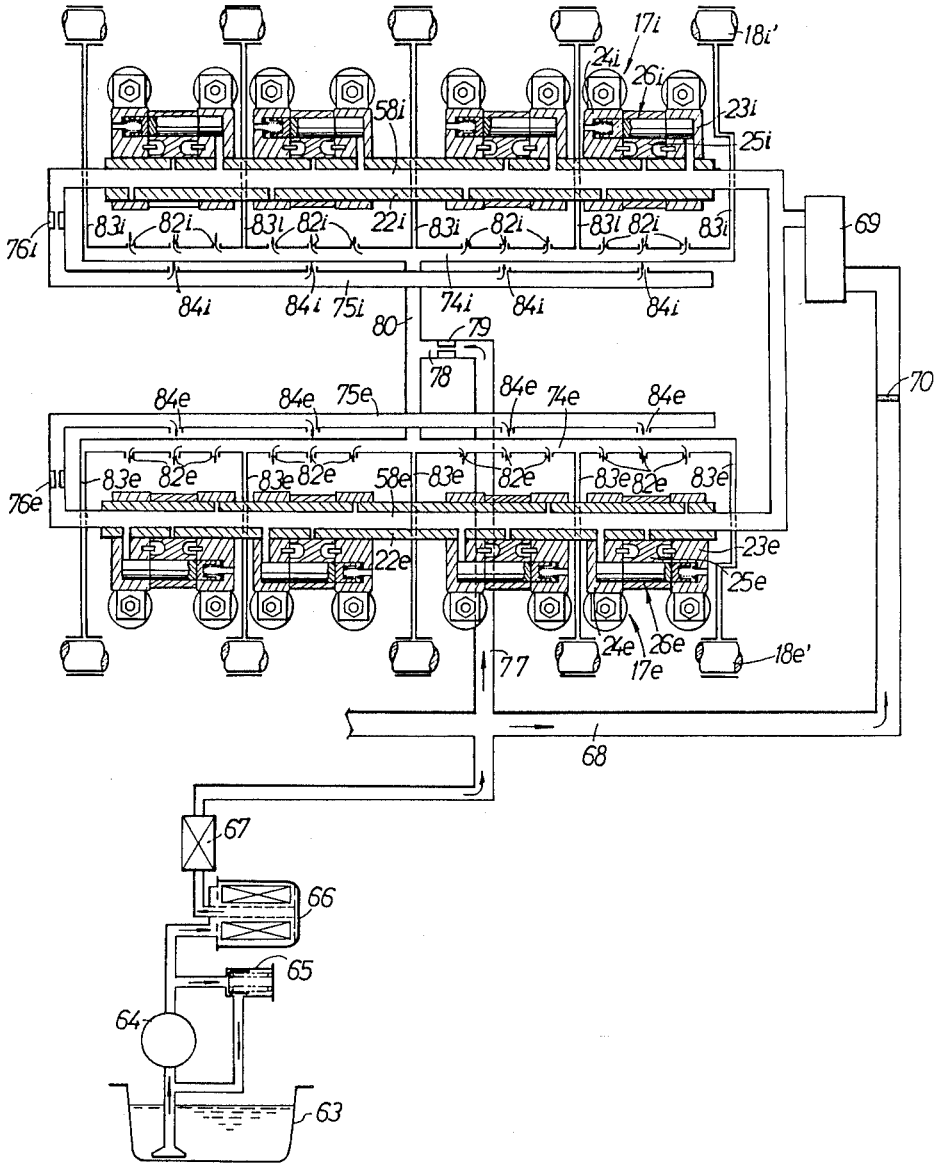
Figure 11:
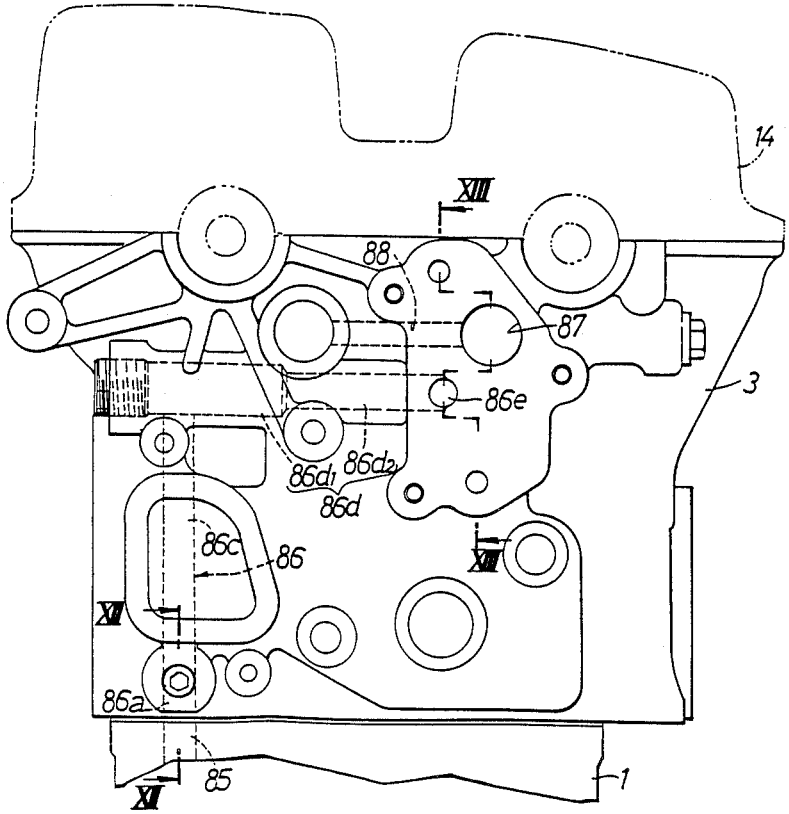
Figure 12:
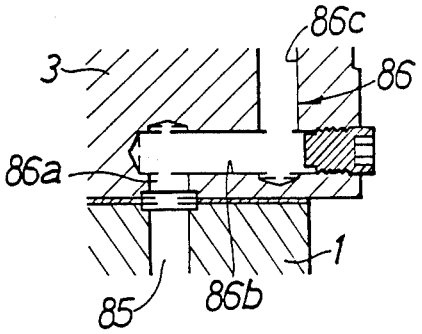

Referring to FIGS. 11 and 12, an oil passage 85 is provided in the cylinder block 1 independently from the aforesaid oil passage 77 to vertically extend at a location closer to one end in the direction of arrangement of the cylinders 2, and it communicates with the oil gallery 68 through the filter 70 (see FIG. 10). On the other hand, the cylinder head 3 is provided, at one end thereof in the direction of arrangement of the cylinders 2, with a high speed oil pressure feed passage 86 communicating with the oil passage 85. The feed passage 86 is comprised of a passage portion 86*a* slightly extending upwardly in communication with an upper end of the oil passage 85, a passage portion 86*b* extending toward one end of the cylinder head 3 in communication with an upper end of the passage portion 86*a*, a passage portion 86*c* extending upwardly in communication with the passage portion 86*b*, a passage portion 86*d* communicating with an upper end of the passage portion 86*c* and extending toward the rocker shaft 22*e* of the exhaust valve operating device 86*d*, and a passage portion 86*e* opened in one end face of the cylinder head 3 in communication with the passage portion 86*d*.

Figure 13:
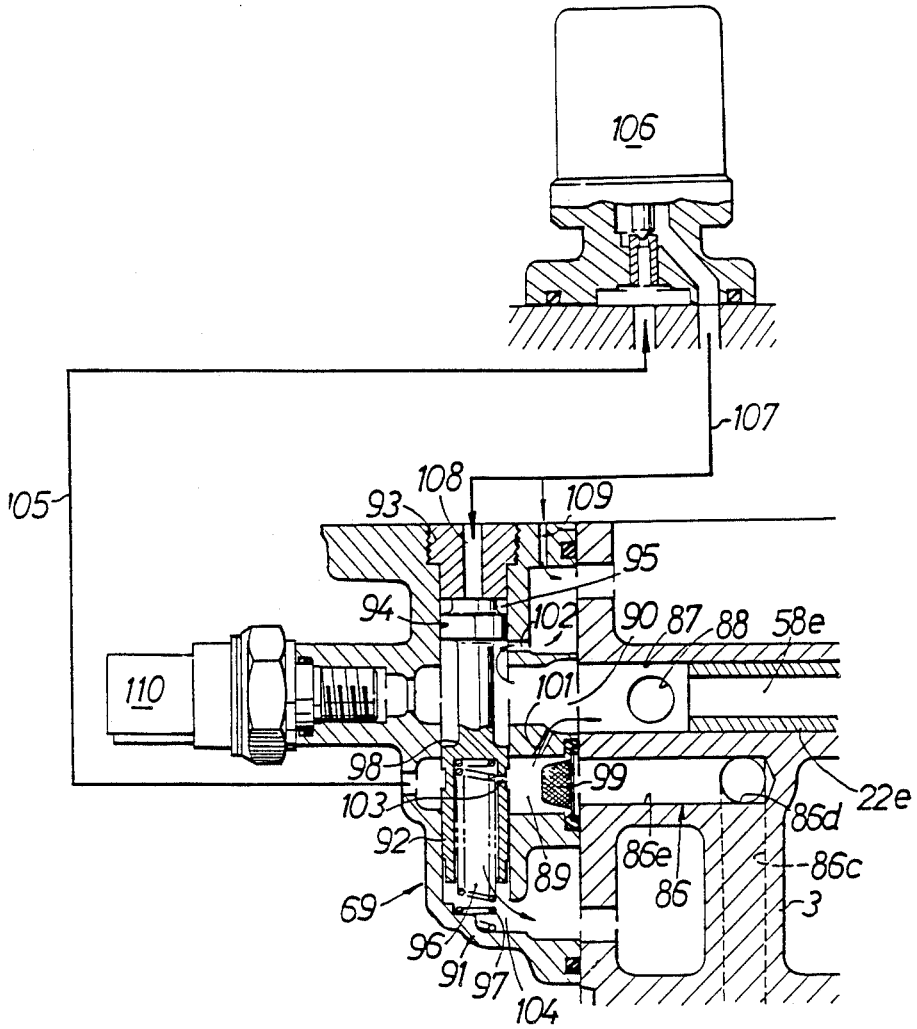

Referring also to FIG. 13, an oil supply port 87 is provided in the cylinder head 3 at a portion supporting one end of one of the rocker shafts 22*i* and 22*e*, i.e., the exhaust side rocker shaft 22*e* to lead to the oil feed passage 58*e* in the rocker shaft 22*e* and is opened in one end face of the cylinder head 3. A communication passage 88 is also provided in the cylinder head 3 for permitting such oil supply port 87 to communicate with the oil feed passage 58 in the intake side rocker shaft 22*i*.

The directional control valve 69 is attached to the one end face of the cylinder head 3 to change-over the connection and disconnection between an opening of the high speed oil pressure feed passage into the one end face of the cylinder head 3, i.e., the passage portion 86*e* and the oil supply port 87. The directional control valve 69 comprises a valve spool 92 slidably received in a housing 91 for movement between a low oil pressure supply position (an upper position) for supplying a low oil pressure to the oil supply port 87 and a high oil pressure supply position (a lower position) for supplying a high oil pressure to the oil supply port 87, the housing 91 being attached to the one end face of the cylinder head 3 to have an inlet port 89 leading to the passage portion 86*e* and an outlet port 90 leading to the oil supply port 87.

The housing 91 is provided with a cylinder bore 94 closed at its upper end by a cap 93, and the valve spool 92 is slidably received in the cylinder bore 94 to define a working oil pressure chamber 95 between the cap 93. A spring 97 for biasing the valve spool 92 upwardly is contained in a spring chamber 96 defined between a lower portion of the housing 91 and the valve spool 92. Thus, the valve spool 92 is biased upwardly, i.e., toward the low oil pressure supply position by the spring 97 and adapted to be moved to the high oil pressure supply position by an oil pressure in the working oil pressure chamber 95 when a high oil pressure is supplied into the working oil pressure chamber 95. The valve spool 92 is provided with an annular recess 98 permitting the communication between the inlet port 89 and the outlet port 90, and as shown in FIG. 13, when the valve spool 92 has been moved upwardly, it is in a state to block the connection between the inlet port 89 and the outlet port 90.

With the housing 91 attached to the end face of the cylinder head 3, an oil filter 99 is clamped between the inlet port 89 and the passage portion 86*e* of the high speed oil pressure feed passage 86. The housing 91 is also provided with an orifice 101 which permits the communication between the inlet port 89 and the outlet port 90. Thus, even in a condition that the valve spool 92 is in its closing position, the inlet port 89 and the outlet port 90 are in communication with each other through the orifice 101, so that an oil pressure restricted by the orifice 101 may be supplied from the outlet port 90 into the oil supply port 87.

In addition, the housing 91 is provided with a by-pass port 102 which leads to the outlet port 90 through the annular recess 98 only when the valve spool 92 is in its closing position. The by-pass port 102 communicates with an upper portion within the cylinder head 3. The housing 91 is further provided with an orifice 103 which permits the inlet port 89 to communicate with the spring chamber 96 regardless of the position of the valve spool 92. Moreover, a through hole 104 is made in a lower portion of the housing 91 for permitting the spring chamber 96 to communicate with the interior of the cylinder head 3, so that oil flowing into the spring chamber 96 via the orifice 103 may be returned into the cylinder head via the through hole 104. This avoids an adverse influence on the expansion and compression of the spring 97 by dust, or the like, deposited on the spring 97, because the dust, or the like, is carried off by the oil.

A line 105 is connected to the housing 91 to normally communicate with the inlet port 89 and also connected to a line 107 through a solenoid valve 106. In turn, the line 107 is connected to a connection hole 108 made in the cap 93.

Also, the housing 91 is provided with a leak jet 109 communicating with the line 107 and leading to an upper portion within the cylinder head 3.

Now, if the solenoid valve 106 is opened to move the valve spool 92 of the directional control valve 69 from the low oil pressure supply position to the high oil pressure supply position, working oil within the high speed oil pressure feed passage 86 flows into the oil supply passages **58*i* and 58*e* in a moment. For this reason, it is feared that a temporary reduction in oil pressure might be produced in the high oil pressure feed passage 86 just in front of the directional control valve 69. In order to avoid such a temporary reduction in oil pressure, a portion having a sufficient volume is provided in a location just in front of the directional control valve 69 on the way of the high oil pressure feed passage 86 to exhibit an accumulator effect. More specifically, and referring again to FIG. 11, the passage portion 86*d* made substantially horizontally in the cylinder head 3 is comprised of an increased diameter portion $86d_1$ leading to the vertically extending passage portion 86*c*, and a smaller diameter portion $86d_2$ connected to the increased diameter portion $86d_1$ through a step, the increased diameter portion $86d_1$ being configured to have a sufficient volume. In addition, the smaller diameter portion $86d_2$ has a cross-sectional area set at a larger level than that of the passage portion 86*c***.

Further, a pressure detector 110 is attached to the housing 91 for detecting the oil pressure in the outlet port 90 and thus in the oil feed passages **58*i* and 58*e* and functions to detect whether or not the directionally control valve 69** operates normally.

Figure 14:
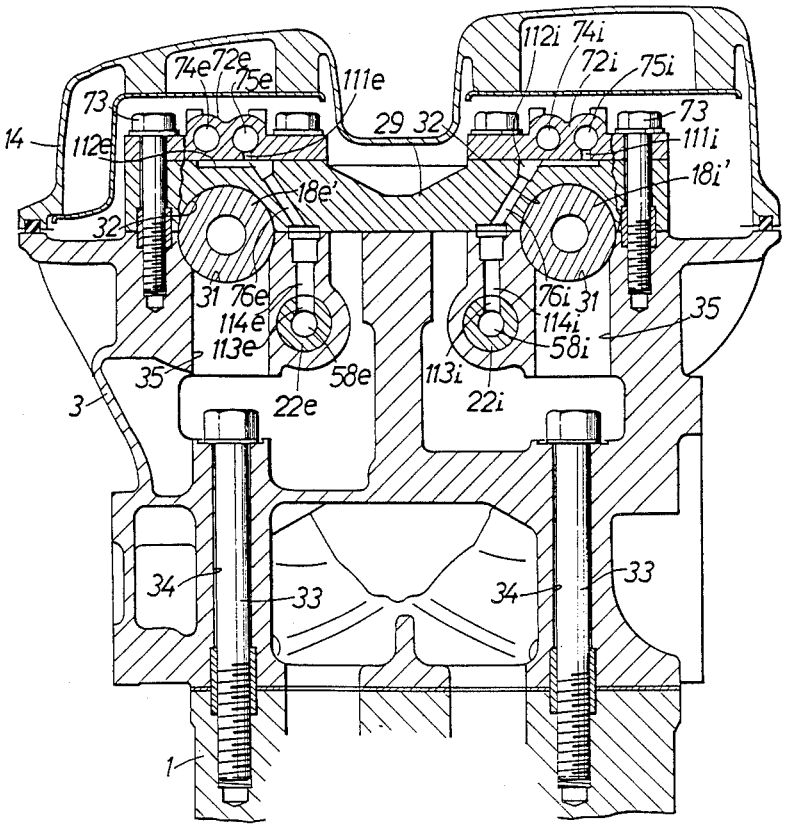

Referring to FIG. 14, on the other end side, i.e., on the opposite side of the cylinder head 3 from the position of attachment of the directional control valve 69, communication holes **111*i* and 111*e*, that open downwardly are made in the ends of the passage defining members 72*i* and 72*e* to lead to the high speed lubricating oil passages 75*i* and 75*e*, respectively, and a pair of grooves are provided in the upper surface of the cam holder 29 to define passage 112*i* and 112*e* leading to the communication holes 111*i* and 111*e* between the passage defining members 72*i* and 72*e*, respectively. In addition, communication holes 113*i* and 113*e* are made in the ends of the rocker shafts 22*i* and 22*e* to lead to the oil feed passages 58*i* and 58*e*, respectively, and passages 114*i* and 114*e* made in the cylinder head 3 in communication with these communication holes 113*i* and 113*e* communicate with the passages 112*i* and 112*e* through the restrictions 76*i* and 76*e* made in the cam holder 29. Thus, the oil supplied into the oil feed passages 58*i* and 58*e* may be supplied into the high speed lubricating oil passage 75*i* and 75*e* through the restrictions 76*i* and 76*e***.

The operation of this embodiment will be described below. The lubricating oil is supplied into the low speed lubricating oil passage **74*i* and 74*e* through the oil passage 77, the low speed oil pressure feed passage 78 and the bifurcated oil passage 80 which are independent from the connection change-over mechanisms 26*i* and 25*e* and hence, even if the connection change-over mechanisms 26*i* and 26*e* are operated, a given oil pressure can be always supplied despite such operation. Thus, the lubricating oil can be supplied under a stable pressure to the slide portions between the low speed cams 19*i*, 19*e*, 20*i* and 20*e* and the drive rocker arms 23*i*, 23*e*, 24*i* and 24*e* and the slide portions between the high speed cams 21*i* and 21*e* and the free rocker arms 25*i* and 25*e*, as well as cam journals 18*i*' and 18*e*' of the cam shafts 18*i* and 18*e***.

Moreover, since the oil passage 77, the low speed oil pressure feed passage 78 and the bifurcated oil passage 80 are disposed substantially at the center in the direction of arrangement of the cylinders 2, it is possible to provide a uniform amount of lubricating oil with a substantially constant flowing pressure loss thereof up to the individual lubricating oil ejecting apertures **82*i* and 82*e* and the individual lubricating oil feed passages 83*i* and 83*e***.

When the connection change-over mechanisms **26*i* and 26*e* are to be operated for change-over to bring the intake valves 10*i* and the exhaust valves 10*e* into a high speed operation mode, the solenoid valve is opened. This causes an oil pressure to be supplied into the working oil pressure chamber 95, so that the valve spool 92 is operated for opening the valve under the action of a hydraulic pressure provided by the oil pressure in the working oil pressure chamber 95 to permit supplying of the oil pressure into the oil fed passages 58*i* and 58*e*. The supplying of the oil pressure into the oil pressure chamber 56 causes the connection change-over mechanisms 26*i* and 26*e* to be operated for connection, thus permitting the opening and closing operation of the intake valves 10*i* and the exhaust valves 10*e*** in the high speed operation mode.

In this case, a relatively large amount of the working oil is supplied from the high speed oil pressure feed passage 86 into the oil supply passages **58*i* and 58*e*, but the oil pressure can be smoothly supplied while preventing any pulsation from being produced in the oil pressure to be supplied into the oil supply passages 58*i* and 58*e*, because the increased diameter portion $86d_1$ of the passage portion 86*d* provides a sufficient volume. Moreover, although there is a possibility that the working oil may be expanded to produce air during flowing of the working oil from the passage portion 86*c* to the increased diameter portion $86d_1$, it is possible to avoid flowing of the air toward the directional control valve 69 to the utmost and to avoid any air biting from being produced in the directional control valve 69**.

In this high speed operation mode, the lubricating oil supplied into the high speed lubricating oil passages **75*i* and 75*e* is ejected through the lubricating oil ejecting apertures 84*i* and 84*e*, and this enables a satisfactory lubrication, particularly of the slide portions between the high speed cams 21*i* and 21*e* having a larger surface pressure and the free rocker arms 25*i* and 25*e***.

Now, when the directional control valve 69 has been operated to provide the change-over from the low speed operation mode to the high speed operation mode, there is a slight time lag up to increasing of the oil pressure in the high speed lubricating oil passages **75*i* and 75*e* by the restriction, and there is a slight time lag up to ejection of the lubricating oil through the lubricating oil ejecting apertures 84*i* and 84*e*. Since the lubricating oil ejecting apertures 82*i* and 82*e* leading to the low speed lubricating oil passages 74*i* and 74*e* are disposed even at locations corresponding to the slide portions between the high speed cams 21*i* and 21*e* and the free rocker arms 25***i* and 25*e*, however, the lubricating oil cannot be insufficient at the slide portions between the high speed cams 21*i* and 21*e* and the free rocker arms 25*i* and 25*e* even if there is a slight time lag, as described above. When the directional control valve 69 has been closed with the individual pins 51, 52 and 53 in the connection change-over mechanisms .26*i* and 26*e* remaining locked to produce a condition in the low speed operation mode, the surface pressure on the slide portions between the high speed cams 21*i* and 21*e* and the free rocker arms 25*i* and 25*e* is increased as in the high speed operation mode. Even in this case, however, satisfactory lubrication can be provided because the lubricating oil is ejected through the lubricating oil ejecting apertures 82*i* and 82*e* leading to the low speed lubricating oil passages 74*i* and 74*e* onto the slide portions between the high speed cams 21*i* and 21*e* and the free rocker arms 25*i* and 25*e*.

In some cases, axes of the first guide hole 55, the guide aperture 59 and the second guide hole 60 cannot be completely aligned during connecting by the connection change-over mechanism 26*i* due to the production tolerances of the rocker arms 23*i*, 24*i* and 25*i*. However, when the free rocker arm 25*i* slides on the base circle of the high speed cam 21*i*, the second spring 128 in the resiliently biasing means 124*i* is in a state of its free length, and there is a gap between the urging piston 126 and the retainer 129. Therefore, it is possible to provide a slightly swinging movement of the free rocker arm 25*i* while compressing the first spring 127 having a spring constant set at a relatively small valve and hence, to bring the axes into complete alignment by pushing the free rocker arm 25*i* slightly up or down at a leading end of the first change-over pin 51.

Further, in the high speed operation mode, the both intake valves 10*i*are driven to be opened and closed by the free rocker arm 25*i* and hence, it is necessary to ensure slidable contact of the free rocker arm 25*i* with the high speed cam 21*i*, and the resilient biasing means 124*i* is required to urge the free rocker arm 25*i* toward the cam shaft 18*i* with a relatively strong spring force. When the higher portion of the high speed cam 21*i* slides on the free rocker arm 25*i*, the first spring 127 with a relatively decreased spring force is in compression until the urging piston 126 is caused to abut against the retainer 129, and the urging piston 126 is biased toward the cam shaft 18*i* by the second spring 128 having a spring constant relatively increased. This causes the free rocker arm 25*i* to be brought into slidable contact with the high speed cam 21*i* with a relatively large spring force, thereby providing a high lift load.

When the opening and closing operation of the intake valve 10*i* and the exhaust valves 10*e* is to be changed over from the high speed operation mode to the low speed operation mode, the solenoid valve 106 is closed. During this closing of the solenoid valve 106, the oil pressure within the line 107 is escaped through the leak jet 109, so that the oil pressure in the working oil pressure chamber 95 is rapidly released and in response to this, the directional control valve 69 is rapidly closed. Moreover, when the directional control valve 69 becomes closed, the oil pressure in the oil feed passages 58*i* and 58*e* is escaped through the by-pass port 102 into the cylinder head 3 and therefore, the oil pressure is rapidly reduced in the oil feed passages 58*i* and 58*e* and thus within the oil pressure chambers 56 in the connection change-over mechanisms 26*i* and 26*e*, leading to an improved response for changing-over from the high speed operation mode to the low speed operation mode.

Now, in the resiliently biasing means 124*i*, the urging piston 126 reciprocally slides within the guide member 125 in response to the swinging movement of the free rocker arm 25*i* provided by the high speed cam 21*i* irrespective of the high speed operation mode and the low speed operation mode of the engine. In accordance with the reciprocally sliding movement of the urging piston 126, the volume of the oil chamber 132 repeatedly expands and contracts and during contraction, the lubricating oil within the oil chamber 132 is ejected through the ejecting apertures 133 and 133. Moreover, since the ejecting directions of the ejecting apertures 133 and 133 are directed to between the first and second drive rocker arm 23*i* and 24*i* and the free rocker arm 25*i* at the place of disposition of the connection change-over mechanism 26*i*, the lubricating oil ejected will be supplied to the connection change-over mechanism 26*i*. Thus, the lubrication of the connection change-over mechanism 26*i* is possible, even if any oil passage is not especially provided for supplying the lubricating oil to the connection change-over mechanism 26*i*.

Further, since the base portion 36*a* of the central block 36 is formed into an inclined surface toward the lubricating oil inlet passage 134 in the resiliently biasing means 124*i*, the lubricating oil that falls nearly onto the base portion 36*a* of the central block 36 can be effectively collected and supplied into the oil chamber 132. Since the lubricating oil inlet hole 135 is made in the guide member 125 between the lower end edge of the urging piston 126 which is in the uppermost limit position and the lower end edge of the urging piston 126 which is in the lowermost limit position, the introduction and interception of the lubricating oil into the oil chamber 132 can be effectively carried out, and the ejection of the lubricating oil through the ejecting apertures 133 and 133 can be effectively performed.

Moreover, the resiliently biasing means 124*i* and 124*e* are unit-constructed by successively inserting the second spring 128, the retainer 129, the first spring 127 and the urging piston 126 into the guide member 125 and securing the stopper 130 to the guide member 125, and only by fitting this unit-constructed resiliently biasing means 124*i* and 124*e* into the mounting holes 131, assembling thereof to cylinder head 3 can be completed, leading to an extremely facilitated assembling operation. In addition, since the abutments 126*a* of the urging pistons 126 in the resiliently biasing means 124*i* and 124*e* are formed into the tapered configuration, the resiliently biasing means 124*i* and 124*e* can be disposed in close proximity to the portion of the free rocker arms 25*i* and 25*e* which is pivotally supported on the rocker shafts 18*i* and 18*e*. This makes it possible to reduce the inertial weight of the free rocker shafts 25*i* and 25*e*, thereby providing a reduction in driving force.

Further, since the retaining ring 62 capable of engaging the restricting pin 53 is fitted on the inner surface of the second guide hole 60 in the connection change-over mechanisms 26*i* and 26*e*, the restricting pin 53 is reliably prevented from being sprung out of the second guide hole 60 by the action of the return spring 54, even if a force for urging the restricting pin 53 is released in the maintenance of the connection change-over mechanisms 26*i* and 26*e*.

Yet further, since the number of low and high speed oil pressure feed passages 78 and 86 required to be mounted is only one in each case, the working of the cylinder 3 is extremely facilitated. In addition, since the directional control valve 69 is attached to the one end face of the cylinder head 3, the mounting structure is simplified. Moreover, since, the oil feed passages 58*i* and 58*e* are used commonly for supplying of the oil to the connection change-over mechanisms 26*i* and 26*e* and for supplying oil to the high speed lubricating oil passages 75*i* and 75*e*, it is unnecessary to mount any other oil feed line and any other oil feed passage in the cylinder head 3, leading to an avoidance of an increase in the number of parts and in number of working steps, but still, an effective supplying of the oil is possible.

While the abutments 126*a* of the urging pistons 126 against the free rocker arms 25*i* and 25*e* in the resiliently biasing means 124*i* and 124*e* have been formed into the tapered configuration in the above embodiment, the abutments 126*a* may be formed into a small diameter short cylindrical shape forming a step between the body of the urging piston 126. Even if so, the resilient biasing means 124*i* and 124*e* can be disposed in proximity to the portions of the free rocker arms 25*i* and 25*e* pivotally supported on the rocker shafts 18*i* and 18*e*, permitting a reduction in inertial weight of the free rocker shafts 25*i* and 25*e*.

Figure 15:
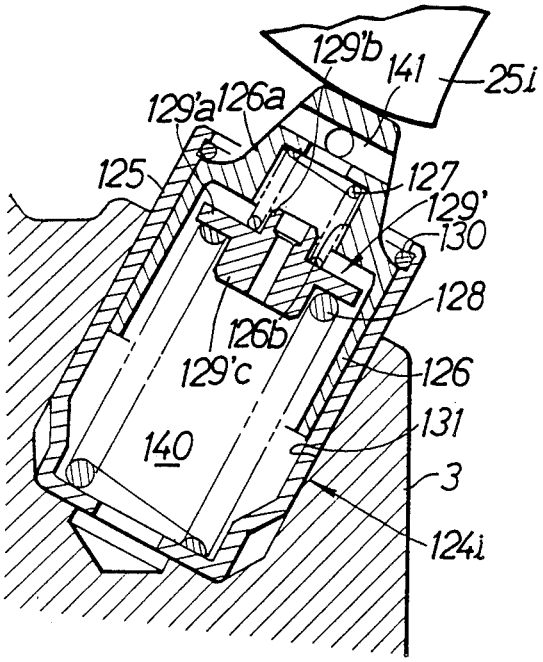
FIGS. 15, 16 and 17 are sectional views similar to FIG. 6 and illustrating resilient biasing means according to second, third and fourth embodiments, respectively.

FIG. 15 illustrates a second embodiment of the present invention, wherein portions corresponding to those in the first embodiment shown in FIGS. 1 to 14 are designated by the same reference characters.

A retainer 129′ in the resilient biasing means 124*i* comprises a projection 129′*b* for fitting of the end of the first spring 127, and a projection 129′*c* for fitting of the end of the second spring 128, these projections 129′*b* and 129′*c* being mounted on the front and back surfaces of a retainer body 129′*a* that is formed into a disk to receive the ends of the first and second springs 127 and 128. Additionally, a spring chamber 140 is defined between the guide member 125 and the urging piston 126 and contains the first and second springs 127 and 128. The abutment 126*a* of the urging piston 126 is provided with an air vent hole 141 permitting the spring chamber 140 to communicate with the outside for the purpose of preventing the interior of the spring chamber 140 from being pressurized and depressurized during sliding movement of the urging piston 126. The air vent hole 141 is formed into a cross-shape so that it is opened to the outer side surface of the abutment 126*a*.

With the second embodiment, the formation of the air vent hole 141 into the cross-shape makes it possible to reduce the weight of the urging piston 126, which contributes to a reduction in inertial weight of the free rocker arm 25*i*. In the high speed operation mode of the engine, the urging piston 126 and the retainer 129′ in the resilient biasing means 124*i* may come into collision with each other in some cases. In order to provide the retainer 129′ with the strength to withstand such collision, the thickness of the retainer body 129′*a* of the retainer 129′ may be increased. Even if the thickness of the retainer body 129′*a* is increased, the diameter of the retainer 129′ cannot be increased and therefore, the strength of the retainer 129′ can be increased without any attendant increase in size of the resiliently biasing means 124*i*.

Figure 16:
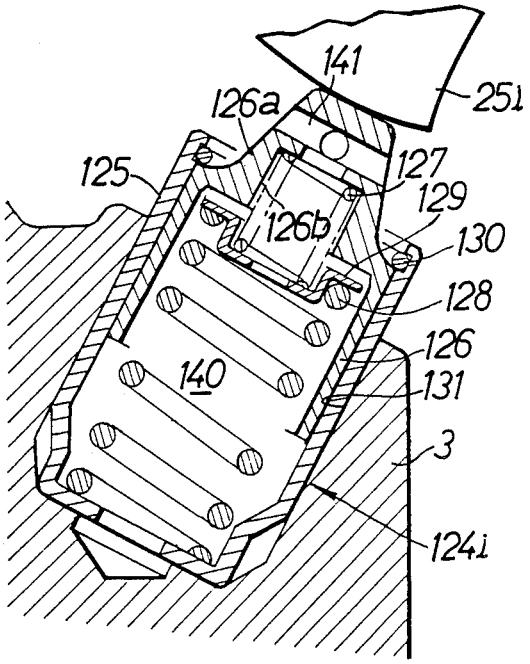

FIG. 16 illustrates a third embodiment of the present invention, wherein portions corresponding to those in the previous individual embodiments are denoted by the same reference characters.

In the resiliently biasing means 124*i*, the second spring 128 interposed between the retainer 129 and the closed end of the guide member 125 is a coiled spring having a non-linear load characteristic of spring loads increasing in variation with an increase in amount of displacement, but having a substantially uniform diameter, e.g., a coiled spring having uneven pitches.

With the third embodiment, the following effects can be provided: In the high speed operation mode of the engine the urging piston 126 in the resiliently biasing means 124*i* is brought into slidable contact with the free rocker arm 25*i* primarily by a spring force of the second spring 128. In this case, because the second spring 128 is a coiled spring having unever pitches, it can exhibit a large spring force in the high speed operation mode to prevent the occurrence of any surging phenomenon, leading to a prevention of the generation of any impact noise due to the surging, while providing an improvement in durability of the second spring 128. In the low speed operation mode, the spring force of the second spring 128 is relatively reduced and hence, it is possible to reduce the loss of friction between the urging piston 126 and the free rocker arm 25*i*. Thus, it is possible to prevent the occurrence of any surging phenomenon during a high speed operation, while avoiding any increase in loss of friction during a low speed operation. In addition, because of the substantially uniform diameter of the second spring, it is possible to avoid increasing the diameter of the resiliently biasing means 124*i*, and any such influence cannot be exerted on surrounding members around the resilient biasing means 124*i*.

Figure 17:
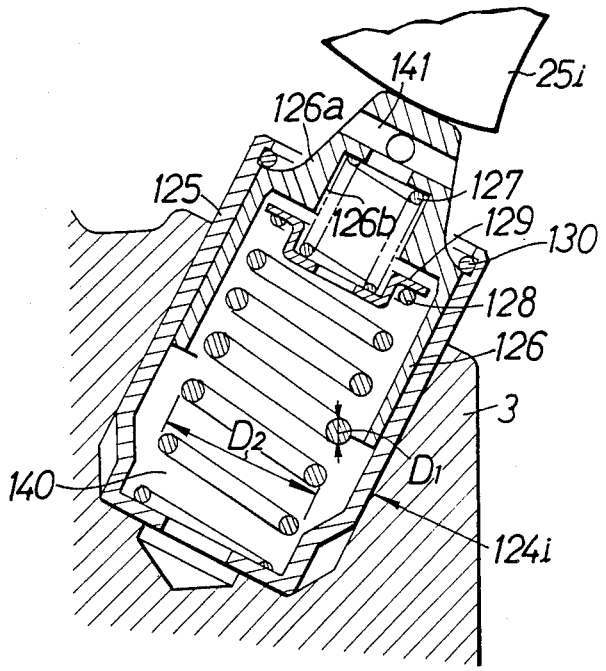

FIG. 17 illurstrates a fourth embodiment of the present invention wherein portions corresponding to those in the previously-described individual embodiments are designated by the same reference characters.

The second spring 128 used in the resilient biasing means 124*i* is a coiled spring having coil element diameters $D_1$ varied lengthwise of the spring but having a substantially uniform entire diameter $D_2$. The second spring 128 is also a coiled spring having a non-linear load characteristic of spring loads increasing in variation with an increase in amount of displacement and can provide effects similar to those of the third embodiment shown in FIG. 16.

While the spring having the non-linear load characteristic of spring loads increasing in variation with an increase in amount of displacement but having the substantially uniform diameter has been used only for the second spring 128 in the embodiments shown in FIGS. 16 and 17, the first spring 127 may be also a similar spring.

What is claimed is:

1. A valve operating system for internal combustion engines, comprising a drive cam follower operatively connected to an engine valve, a free cam follower capable of operation independent of said drive cam follower, said cam followers being adjacently disposed for operation in mutually different modes in response to rotation of a cam shaft, a connection change-over mechanism provided between said cam followers and capable of changing-over connection and disconnection between the followers, and resilient biasing means provided between said free cam follower and an engine body for resiliently urging said free cam follower toward said cam shaft, wherein said resilient biasing means comprises an urging piston slidably received in the engine body for abutment against the free cam follower, and a spring interposed between the urging piston and the engine body to resiliently bias the urging piston in a direction to abut against the free cam follower, the urging piston being provided at an end of the free cam follower in close proximity to the pivot end thereof, with an abutment having a smaller diameter to abut against the free cam follower.

2. A valve operating system for internal combustion engines according to claim 1, further including a bottomed cylindrical guide member fitted in the engine body, in which the urging piston is slidably received, and a stopper detachably fixed to an inner surface of said guide member closer to an opened end thereof so as to engage said urging piston.

3. A valve operating system for internal combustion engines according to claim 2, wherein said stopper comprises a retaining ring of a circular shape with a cut portion.

4. A valve operating system for internal combustion engines according to claim 1, wherein that end of said urging piston closer to the free cam follower is formed with a tapered abutment capable of abutting against said free cam follower.

5. A valve operating system for internal combustion engines according to claim 1 or claim 4, wherein said connection change-over mechanism includes a change-over pin movable between a position in which the adjacent cam followers are connected together and a position in which such connection is released, and the abutment of the urging piston is disposed to abut against the free cam follower between a surface extending through the center line of said change-over pin in parallel to the axis of an engine cylinder and a surface extending through the pivot point of the cam follower in parallel to the axis of the cylinder.

6. A valve operating system for internal combustion engines according to claim 1 or claim 4, wherein said connection change-over mechanism includes a change-over pin movable between a position in which the adjacent cam followers are connected together and a position in which such connection is released, and the axis of said urging piston is directed along a line that extends through the center of said abutment and is disposed between the center of said change-over pin and the pivot point of said cam follower.

7. A valve operating system for internal combustion engines according to claim 1, further including a first spring having a relatively small spring constant and a second spring having a relatively large spring constant, said springs being interposed in series between said urging piston and said engine body.

8. A valve operating system for internal combustion engines according to claim 7, further including a retainer between said first and second springs.

9. A valve operating system for internal combustion engines according to claim 1 or 4, further including a bottomed cylindrical guide member fitted in the engine body, in which said urging piston is slidably received, and an air vent hole made in the abutment of said urging piston for permitting a spring chamber defined between said urging piston and said guide member to communicate with the outside.

10. A valve operating system for internal combustion engines according to claim 9, wherein said air vent hole is cross-shaped so that it is opened to an outer surface of said abutment.

11. A valve operating system for internal combustion engines according to claim 8, wherein said retainer includes projections for fitting ends of said first and second springs, said projections being provided on front and rear surfaces of a disk-shaped body of the retainer to receive said first and second springs.

12. A valve operating system for internal combustion engines according to claim 7 or claim 8, wherein at least the second spring of said first and second springs comprises a coiled spring having a non-linear load characteristic with a spring load increased in variation with an increase in amount of displacement but having a substantially uniform diameter.

13. A valve operating system for internal combustion engines according to claim 1, further including a bottomed cylindrical guide member fitted in the engine body, in which said urging piston is slidably received, an ejecting aperture provided in said urging piston and opened to an end of the piston closer to said free cam follower, a lubricating oil inlet passage provided in the cylinder head of said engine body and opened to an upper surface of the cylinder head to introduce a lubricating oil, and a lubricating oil inlet hole made in said guide member to communicate with said lubricating oil inlet passage and capable of being closed by said urging piston.

14. A valve operating system for internal combustion engines according to claim 13, wherein said connection change-over mechanism includes a change-over pin movable between a position in which the adjacent cam followers are connected together and a position in which such connection is released, and the ejection direction of said ejecting aperture is established toward the spaces between said drive cam follower and said free cam followers at the location in which said connection change-over mechanism is provided.

15. A valve operating system for internal combustion engines according to claim 13, wherein the upper surface of the cylinder head is formed so that it is inclined toward and in the vicinity of an opening of said lubricating oil inlet passage which faces said upper surface of the cylinder head.

16. A valve operating system for internal combustion engines according to claim 13, 14 or 15, wherein said lubricating oil inlet hole is made in said guide member between the upper and lower limits of the stroke of said urging piston.

* * * * *